US011046089B2

(12) United States Patent
Kobayashi et al.

(10) Patent No.: US 11,046,089 B2
(45) Date of Patent: Jun. 29, 2021

(54) THERMAL TRANSFER SHEET, PRINTING SHEET, AND THERMAL TRANSFER PRINTING APPARATUS

(71) Applicant: Dai Nippon Printing Co., Ltd., Tokyo (JP)

(72) Inventors: Yoshimasa Kobayashi, Tokyo (JP); Daijiro Sugihara, Tokyo (JP); Munenori Ieshige, Tokyo (JP); Makoto Hashiba, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 2 days.

(21) Appl. No.: 16/474,657

(22) PCT Filed: Jul. 31, 2018

(86) PCT No.: PCT/JP2018/028642
§ 371 (c)(1),
(2) Date: Jun. 28, 2019

(87) PCT Pub. No.: WO2019/026901
PCT Pub. Date: Feb. 7, 2019

(65) Prior Publication Data

US 2019/0315130 A1 Oct. 17, 2019

(30) Foreign Application Priority Data

Jul. 31, 2017 (JP) ..... JP2017-148112
Jan. 22, 2018 (JP) ..... JP2018-008302

(51) Int. Cl.
*B41J 2/235* (2006.01)
*B41J 2/325* (2006.01)
(Continued)

(52) U.S. Cl.
CPC ..... *B41J 2/325* (2013.01); *B41J 2/235* (2013.01); *B41J 2/4753* (2013.01); *B41J 17/36* (2013.01);
(Continued)

(58) Field of Classification Search
CPC ..... B41J 2/235; B41J 2/4753; B41J 17/36; B41M 5/345; B41M 5/382; B41M 5/40
See application file for complete search history.

(56) References Cited

U.S. PATENT DOCUMENTS 5,260,256 A 11/1993 Takahara et al.
5,351,069 A 9/1994 Koike et al.
(Continued)

FOREIGN PATENT DOCUMENTS

EP 1 872 960 B1 6/2009
EP 2 035 233 B1 4/2010
(Continued)

OTHER PUBLICATIONS

International Search Report and Written Opinion (Application No. PCT/JP2018/028642) dated Nov. 6, 2018.
(Continued)

*Primary Examiner* — Lamson D Nguyen
(74) *Attorney, Agent, or Firm* — Burr & Brown, PLLC

(57) ABSTRACT

There is provided a thermal transfer sheet capable of being identified by a thermal transfer printing apparatus, as well as being capable of preventing color property changes in high-resolution printing and reducing production cost. The thermal transfer sheet 5 of an embodiment includes a dye layer 52 and a protective layer 54 on one surface of a substrate 50. The protective layer 54 contains an invisible light absorbing material and is provided with an identification mark 55 having at least one of a recessed portion and a protruding portion.

13 Claims, 4 Drawing Sheets

(51) Int. Cl.

| | |
|---|---|
| ***B41J 2/475*** | (2006.01) |
| ***B41J 17/36*** | (2006.01) |
| ***B41M 5/34*** | (2006.01) |
| ***B41M 5/382*** | (2006.01) |
| ***B41M 5/40*** | (2006.01) |
| ***B41M 5/52*** | (2006.01) |
| ***B41M 7/00*** | (2006.01) |

(52) U.S. Cl.

CPC ..... *B41M 5/345* (2013.01); *B41M 5/382* (2013.01); *B41M 5/40* (2013.01); *B41M 5/52* (2013.01); *B41M 7/0045* (2013.01)

(56) References Cited

U.S. PATENT DOCUMENTS

| | | | |
|---|---|---|---|
| 5,965,485 | A | 10/1999 | Mizumachi et al. |
| 6,333,295 | B1 | 12/2001 | Saito |
| 2004/0227805 | A1 | 11/2004 | Narita et al. |
| 2005/0095401 | A1 | 5/2005 | Tani et al. |
| 2008/0111877 | A1 | 5/2008 | Heyse et al. |
| 2011/0188124 | A1 | 8/2011 | Yanagita et al. |

FOREIGN PATENT DOCUMENTS

| | | | |
|---|---|---|---|
| EP | 5760763 | B2 | 8/2015 |
| JP | H04-197794 | A1 | 7/1992 |
| JP | H05-201108 | A1 | 8/1993 |
| JP | H06-219060 | A1 | 8/1994 |
| JP | H06-328870 | A1 | 11/1994 |
| JP | H09-272266 | A1 | 10/1997 |
| JP | 2000-033781 | A1 | 2/2000 |
| JP | 2000-103103 | A1 | 4/2000 |
| JP | 2006-091808 | A1 | 4/2006 |
| JP | 2010-064360 | A1 | 3/2010 |
| JP | 2011-158627 | A1 | 8/2011 |
| JP | 2013-001047 | A1 | 1/2013 |
| JP | 2013-014061 | A1 | 1/2013 |
| JP | 5799525 | B2 | 10/2015 |
| JP | 2019-025893 | A1 | 2/2019 |

OTHER PUBLICATIONS

Japanese Office Action (Application No. 2018-008302) dated Jan. 22, 2019 (with English translation).

Japanese Office Action (Application No. 2019-088462) dated Jun. 25, 2019.

Korean Office Action (Application No. 10-2019-7004081) dated Mar. 26, 2019 (with English translation).

Extended European Search Report (Application No. 18841727.3) dated Jun. 26, 2020.

THERMAL TRANSFER SHEET, PRINTING SHEET, AND THERMAL TRANSFER PRINTING APPARATUS

FIELD OF THE INVENTION

The present invention relates to a thermal transfer sheet, a printing sheet, and a thermal transfer printing apparatus.

DESCRIPTION OF RELATED ART

Thermal transfer printers have been widely used which print letters, characters, images, and the like onto an image receiving sheet or any other body to be transferred by using a thermal transfer sheet (ink ribbon). The thermal transfer sheet includes a ribbon (support layer), which is a long strip, and a dye layer disposed on the ribbon, and, optionally, a protective layer and a hot-melt ink layer.

In the known thermal transfer sheet, dye layers for three colors of yellow, magenta, and cyan and a protective layer are sequentially arranged in a plane direction, and, optionally, a detection mark is formed of an ink containing a pigment, such as carbon black or aluminum, between each dye layer or between a dye layer and the adjacent protective layer. A thermal transfer printing apparatus reads the detection mark of the thermal transfer sheet loaded therein to determine a print start position and identify the type and the size of the thermal transfer sheet. However, securing regions where detection marks are formed between the dye layers increases the full length of the thermal transfer sheet, accordingly increasing the amount of the substrate to be used and increasing manufacturing cost. In addition, when detection marks are formed on a base film by printing, scattered ink may be printed at unwanted positions, leading to defects in thermal transfer images.

PTL 1 discloses a thermal transfer sheet including dye layers for two or more colors that are sequentially arranged in a plane direction, wherein any of the dye layers has a two-layer structure and one layer of the two-layer structure forms a detection mark having a difference in color from the adjacent portion. However, since the step of forming a further detection layer (dye layer) is required for the detection mark, the manufacturing cost increases. In addition, when a high-resolution image is printed, the color properties of the image may vary.

PTLs 2 and 3 each disclose a thermal transfer dye sheet including a yellow dye layer, a magenta dye layer, and a cyan dye layer, wherein the yellow dye layer has a print region (detection mark) for a binary code or the like producing a difference in optical density capable of being detected by a printer, the print region being formed by varying the thickness of the yellow dye. However, since the thickness of the dye layer is varied so as to produce a difference in optical density, color properties in high-resolution printing may vary.

PTLs 4 and 5 each disclose a thermal transfer sheet including dye layers for one or more colors sequentially arranged in a plane direction and a detection layer disposed between the substrate and the dye layers or between the substrate and a rear surface layer. However, since the step of forming the detection layer is required, the manufacturing cost increases.

PTL 1: Japanese Patent No. 5799525
PTL 2: European Patent No. 1872960
PTL 3: European Patent No. 2035233
PTL 4: Japanese Patent No. 5760763

PTL 5: Japanese Patent Application Publication No. 2013-1047

SUMMARY OF THE INVENTION

Accordingly, the present invention takes account of such circumstances and an object of the present invention is to provide a thermal transfer sheet capable of being identified by a thermal transfer printing apparatus, as well as being capable of preventing color property changes in high-resolution printing and reducing production cost. Also, it is an object of the present invention to provide a printing sheet capable of being identified by a thermal transfer printing apparatus. Furthermore, it is an object of the present invention to provide a thermal transfer printing apparatus configured to identify the thermal transfer sheet or a printing sheet loaded therein and perform printing operation.

According to the present invention, a thermal transfer sheet includes a dye layer and a protective layer disposed on one surface of a substrate, wherein the protective layer contains an invisible light absorbing material and is provided with an identification mark having at least one of a recessed portion and a protruding portion.

According to one aspect of the present invention, the identification mark has a protruding strip or a recessed strip.

According to one aspect of the present invention, the protruding strip or the recessed strip extends in a transverse direction of the sheet.

According to one aspect of the present invention, the identification mark is located at a periphery of the protective layer that is not transferred to printing paper.

According to the present invention, a thermal transfer printing apparatus includes a thermal head and a platen roll and in which the thermal head heats the thermal transfer sheet according to the present invention to transfer a dye onto a printing paper while the thermal transfer sheet and the printing paper, lying one on the other, are transported between the thermal head and the platen roll, thus forming an image on the printing paper and transferring the protective layer onto the image. The thermal transfer printing apparatus includes a detector disposed between a feeder feeding the thermal transfer sheet and the thermal head, the detector detecting the identification mark, a memory storing a table in which a type of the thermal transfer sheet and a pattern of the identification mark are associated with each other, and an identification unit referring to the table and identifying the thermal transfer sheet fed from the feeder based on the pattern detected by the detector.

According to one aspect of the present invention, the pattern of the identification mark is represented by the number of strips or portions, a width, a shape or a position of the identification mark.

According to the present invention, a thermal transfer printing apparatus includes a thermal head and a platen roll and in which the thermal head heats a thermal transfer sheet including a dye layer and a protective layer containing an invisible light absorbing material to transfer a dye onto a printing paper while the thermal transfer sheet and the printing paper, lying one on the other, are transported between the thermal head and the platen roll, thus forming an image on the printing paper and transferring the protective layer onto the image. The thermal transfer printing apparatus includes a detector disposed between a feeder feeding the thermal transfer sheet and the thermal head, the detector applying invisible light to the protective layer and measuring an intensity of invisible light transmitted through or reflected from the protective layer, a memory storing a table in which a type of the thermal transfer sheet and the intensity are associated with each other, and an identification referring to the table and identifying the thermal transfer sheet fed from the feeder based on a measurement result of the detector.

According to one aspect of the present invention, the table contains printing conditions associated with each type of the thermal transfer sheet, and printing operation is performed under the printing conditions associated with the type of the thermal transfer sheet identified by the identification unit.

According to the present invention, a printing sheet includes a substrate, an intermediate layer disposed on the substrate, and a receiving layer disposed on the intermediate layer. The intermediate layer contains an invisible light absorbing material and is provided with an identification mark including at least one of a recessed portion and a protruding portion.

According to one aspect of the present invention, the identification mark includes a protruding strip or a recessed strip.

According to the present invention, a thermal transfer printing apparatus includes a thermal head and a platen roll and in which the thermal head heats the thermal transfer sheet according to the present invention to transfer a dye onto the printing sheet according to the present invention while the thermal transfer sheet and the printing sheet, lying one on the other, are transported between the thermal head and the platen roll, thus forming an image on the printing sheet and transferring the protective layer onto the image. The thermal transfer printing apparatus includes a first detector disposed between a feeder feeding the thermal transfer sheet and the thermal head, the first detector detecting a first identification mark provided in the protective layer, a second detector detecting a second identification mark provided in the intermediate layer, a memory storing a table in which a type of the thermal transfer sheet and a pattern of the first identification mark are associated with each other and a table in which a type of the printing sheet and a pattern of the second identification mark are associated with each other, and an identification unit referring to the tables, identifying the type of the thermal transfer sheet based on the pattern detected by the first detector, and identifying the type of the printing sheet based on the pattern detected by the second detector.

According to one aspect of the present invention, the thermal transfer printing apparatus further includes a light source applying invisible light to the thermal transfer sheet and the printing sheet. The printing sheet is irradiated with invisible light transmitted through the protective layer, the first detector receives light from the protective layer, and the second detector receives light from the printing sheet, the light having been transmitted through the protective layer.

According to one aspect of the present invention, the protective layer of the thermal transfer sheet contains an ultraviolet light absorbing material, and the intermediate layer of the printing sheet contains a fluorescent brightening agent.

ADVANTAGEOUS EFFECTS OF INVENTION

The present invention enables a thermal transfer printing apparatus to identify thermal transfer sheets, as well as to prevent color property changes in high-resolution printing and reduce production cost.

DETAILED DESCRIPTION OF THE INVENTION

Figure 1:
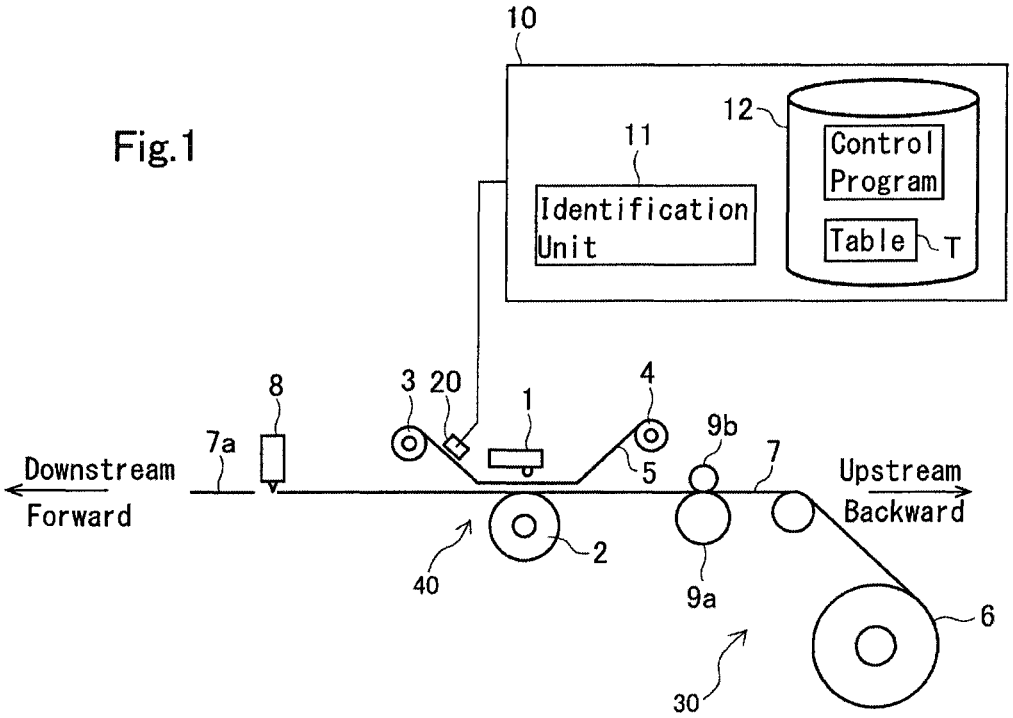
FIG. 1 is a schematic diagram of the structure of a thermal transfer printing apparatus according to an embodiment of the present invention.
Figure 2:
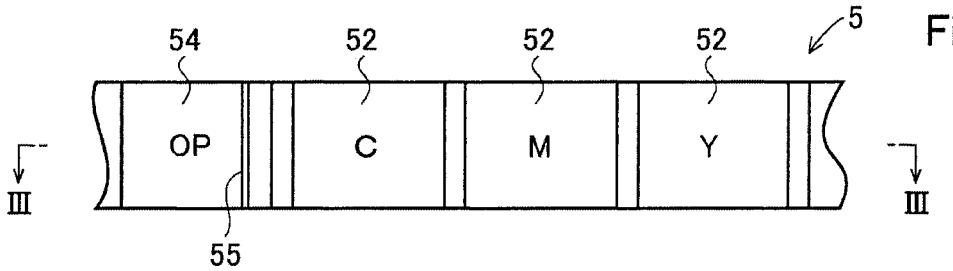
FIG. 2 is a plan view of a thermal transfer sheet according to the embodiment.
Figure 3:
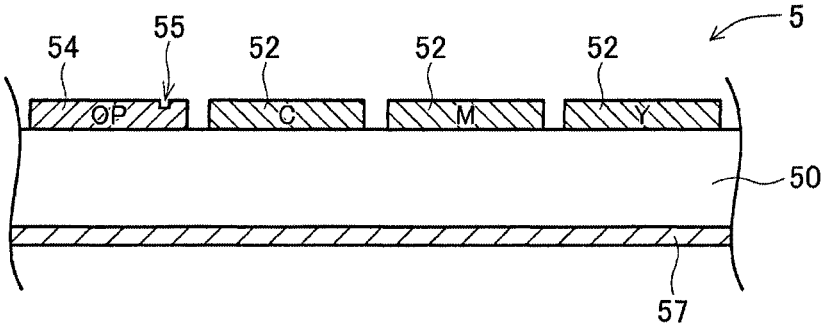
FIG. 3 is a sectional view taken along line III-III shown in FIG. 2.

FIG. 1 is a schematic diagram of a thermal transfer printing apparatus according to an embodiment of the present invention, FIG. 2 is a plan view of a thermal transfer sheet 5 used in the thermal transfer printing apparatus, and FIG. 3 is a sectional view of the thermal transfer sheet 5.

The thermal transfer sheet 5 includes: dye layers 52 containing a dye and a binder resin and a transfer protective layer (hereinafter referred to as a protective layer 54) that are repetitively and sequentially arranged in a plane direction on one surface of a substrate 50; and a rear surface layer 57 on the other surface of the substrate 50. The dye layers 52 include yellow (Y) dye layers, magenta (M) dye layers and cyan (C) dye layers that are sequentially arranged in a plane direction. A dye primer layer may be disposed between the substrate 50 and the arrangement of the dye layers 52 and the protective layers 54. Also, a rear primer layer may be disposed between the substrate 50 and the rear surface layer 57.

The thermal transfer printing apparatus includes a thermal head 1 configured to sublimate and transfer Y, M and C onto a printing sheet 7 (printing paper, image-receiving paper) with the thermal transfer sheet 5, thus printing an image and forming a protective layer over the image.

A feeder 3 formed by winding the thermal transfer sheet 5 thereon is disposed downstream from the thermal head 1, and a collecting unit 4 is disposed upstream from the thermal head 1. The thermal transfer sheet 5 fed from the feeder 3 passes the thermal head 1 and is taken up by the collecting unit 4.

A rotatable platen roll 2 is disposed below the thermal head 1. A printing unit 40, which includes the thermal head 1 and the platen roll 2, pinches the printing sheet 7 and the thermal transfer sheet 5 and heats the thermal transfer sheet 5 to transfer dyes onto the printing sheet 7, thus forming an image.

The printing unit 40 also heats the protective layer 54 to transfer the protective layer onto the image. By increasing transfer energy for forming the protective layer (printing energy for printing by the printing unit 40), the surface of the protective layer becomes matt and has a low glossiness; by reducing the transfer energy, the surface of the protective layer becomes glossy and has a high glossiness.

A rotatable capstan roller 9a for transporting the printing sheet 7 and a pinch roller 9b for pressing the printing sheet 7 on the capstan roller 9a are disposed upstream from the thermal head 1.

The printing sheet 7 is wound on a printing paper roll 6 and fed from the printing paper roll 6. The printing sheet 7 may be a known one. A driving section 30, which includes the printing paper roll 6, the capstan roller 9*a*, and the pinch roller 9*b*, feeds the printing sheet 7 (transports the printing sheet forward) and takes up the printing sheet (transports the printing sheet backward).

The printing sheet 7 that has been subjected to image formation and transfer of the protective layer in the printing unit 40 is cut into a printed cut sheet 7*a* with a cutter 8 on the downstream side. The printed cut sheet 7*a* is ejected through an ejection port (not shown).

In the present embodiment, the protective layer 54 of the thermal transfer sheet 5 contains an invisible light absorbing material. The invisible light absorbing material may be, for example, a fluorescent brightening agent, an ultraviolet light absorbing material, or an infrared light absorbing material. A detector 20 suitable for a type of the invisible light absorbing material is disposed in the vicinity of the feeder 3.

If the protective layer 54 contains a fluorescent brightening agent, a fluorescence sensor is used as the detector 20, and the protective layer 54 is irradiated with ultraviolet light. The detector 20 receives fluorescence emitted from the protective layer 54 to measure the fluorescence intensity. If the protective layer 54 contains an ultraviolet light absorbing material or an infrared light absorbing material, an ultraviolet sensor or an infrared sensor is used as the detector 20, and the protective layer 54 is irradiated with ultraviolet light or infrared light. The detector 20 measures the intensity (reflectance or transmittance) of light reflected from or transmitted through the protective layer 54. Ultraviolet light refers to a radiation having a maximum absorption wavelength ($\lambda$max) range of 280 nm or more and 400 nm or less. Infrared light refers to a radiation having a maximum absorption wavelength ($\lambda$max) range of 780 nm or more and 1 mm or less. The wavelength range of visible light is from more than 400 nm to less than 780 nm.

The protective layer 54 has an identification mark 55 therein, and the measurement value of the detector 20 corresponding to the portion of the identification mark 55 is different from the measurement value of the detector 20 corresponding to the region other than the portion of the identification mark 55.

Figure 4A:
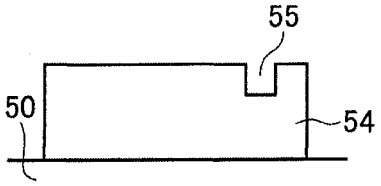
FIGS. 4*a* and 4*b* each show the section of a protective layer.
Figure 4B:
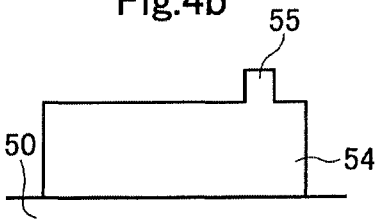

For example, the identification mark 55 may be defined by a recessed portion having a thickness smaller than the region other than the portion of the identification mark 55, as shown in FIG. 3 and FIG. 4*a*. Alternatively, the identification mark 55 may be defined by a protruding portion having a thickness larger than the region other than the portion of the identification mark 55, as shown in FIG. 4*b*.

For example, the identification mark 55 may be defined by a protruding or recessed strip (line pattern) extending in the width direction (the transverse direction (short length direction) of the sheet perpendicular to the longitudinal direction of the sheet) of the thermal transfer sheet. In this instance, when the detector 20 irradiates the protective layer 54 of the thermal transfer sheet 5 fed and transported from the feeder 3 with ultraviolet light or infrared light and scans the protective layer 54 in the longitudinal direction, the measurement value varies at an edge of the identification mark 55. The detector 20 thus detects the pattern of the identification mark 55 represented by the number of strips or portions, the width, the shape, the position or the like of the mark.

For example, in the case of the protective layer 54 containing a fluorescent brightening agent, the position at which the detector 20 starts receiving fluorescence corresponds to the front edge of the protective layer 54. Subsequently, the position at which the fluorescence intensity increases (decreases) corresponds to the edge of one of the ends of the identification mark 55, and then, the position at which the fluorescence intensity decreases (increases) corresponds to the edge of the other end of the identification mark 55. The position from which the detector 20 no longer receives fluorescence corresponds to the rear edge of the protective layer 54.

Figure 5A:
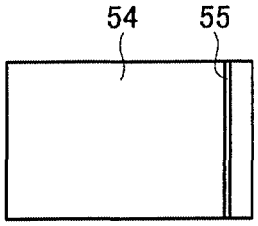
FIGS. 5*a* and 5*b* are each a plan view of a protective layer.
Figure 5B:
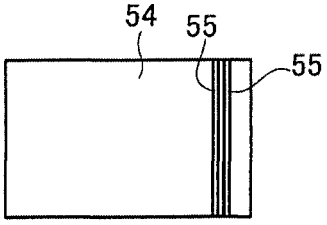
Figure 6A:
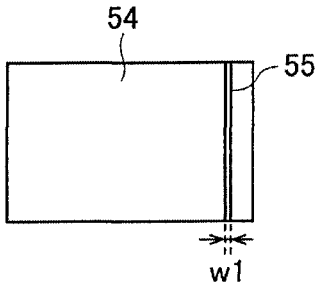
FIGS. 6*a* and 6*b* are each a plan view of a protective layer.
Figure 6B:
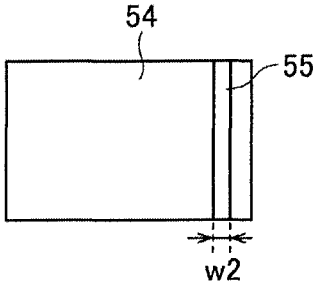
Figure 7A:
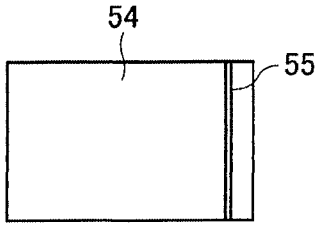
FIGS. 7*a* and 7*b* are each a plan view of a protective layer.
Figure 7B:
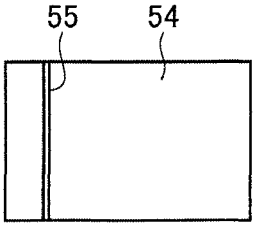
Figure 8A:
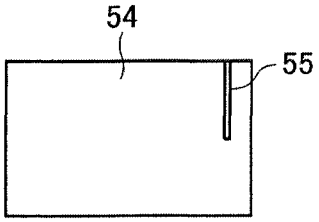
FIGS. 8*a* and 8*b* are each a plan view of a protective layer.
Figure 8B:
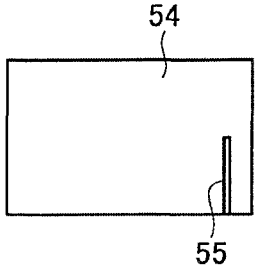

Plural types of thermal transfer sheet 5 may be loaded in the thermal transfer printing apparatus. The type of thermal transfer sheet 5 and the pattern (the number of strips or portions, the width, the shape, or the position) of the identification mark 55 are recorded in association with each other in a table T in a memory 12 that will be described later herein. For example, the number of strips of the identification mark 55 may vary depending on the type of thermal transfer sheet 5, as shown in FIGS. 5*a* and 5*b*. For example, the width of the identification mark 55 denoted by w1 or w2 may vary depending on the type of thermal transfer sheet 5, as shown in FIGS. 6*a* and 6*b*. For example, the position of the identification mark 55 in the longitudinal direction of the thermal transfer sheet may vary depending on the type of thermal transfer sheet 5, as shown in FIGS. 7*a* and 7*b*. For example, the identification mark 55 may be formed on a part in the transverse direction of the sheet, and the position of the identification mark 55 in the transverse direction of the sheet may vary depending on the type of thermal transfer sheet 5, as shown in FIGS. 8*a* and 8*b*. The type of thermal transfer sheet 5 may be represented by a combination of the number of strips or portions, the width, the shape, the position and the like of the identification mark 55.

Figure 9:
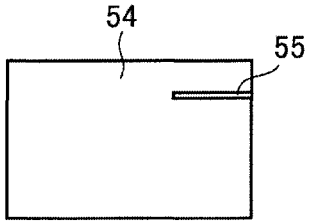
FIG. 9 is a plan view of a protective layer.
Figure 10:
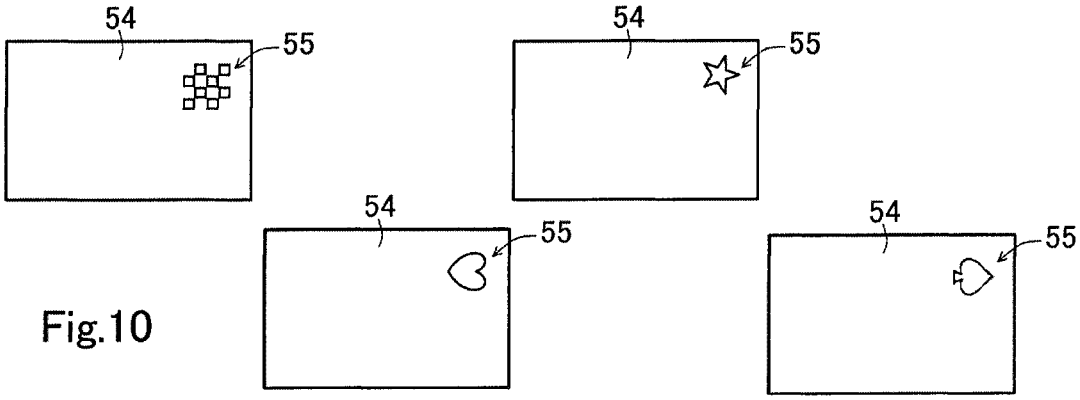
FIG. 10 is a representation of some plan views of protective layers.

The identification mark 55 defined by a protruding strip or a recessed strip may extend in the longitudinal direction of the sheet, as shown in FIG. 9. The identification mark 55 is not necessarily in the shape of a straight line but may be in the shape of a wavy line. The identification mark 55 is not limited to a line pattern and may be a checkered pattern or a pattern in a shape of hart, star, spade or the like, as shown in FIG. 10.

A control device 10 controls the operation of members or components of the thermal transfer printing apparatus and operates for identification of the thermal transfer sheet 5 and printing. The control device 10 is a computer including a CPU (central processing unit) and a memory 12 including a flash memory, a ROM (Read-only Memory), and/or a RAM (Random Access Memory). The memory 12 stores a control program and the above-mentioned table T. The CPU executes the control program to implement an identification unit 11.

The identification unit 11 refers to the table T and identifies the type of thermal transfer sheet 5 from the detection result of the detector 20 for the identification mark 55. In the table T, suitable printing conditions (printing speed, energy applied for printing), the type of printing sheet 7 to be used, and other information may be recorded in association with each type of thermal transfer sheet 5. If the type of the printing sheet 7 loaded in the thermal transfer printing apparatus is not suitable for the type of the identified thermal transfer sheet 5, the control device 10 may output an alarm sound or a warning sign or may cancel the printing operation.

The structure of the thermal transfer sheet 5 will now be described.

[Substrate]

The substrate 50 used for the thermal transfer sheet 5 may be any known thermal transfer sheet, provided that it is resistant to heat to some extent and has some strength. Examples of such a substrate include polyethylene terephthalate films, 1,4-polycyclohexylenedimethylene terephthalate films, polyethylene naphthalate films, polyphenylene sulfide films, polystyrene films, polypropylene films, polysulfone films, aramid films, polycarbonate films, polyvinyl alcohol films, cellulose derivatives, such as cellophane and cellulose acetate, polyethylene films, polyvinyl chloride films, nylon films, polyimide films, ionomer films, and other resin films.

The thickness of the substrate 50 is generally approximately 0.5 μm or more and 50 μm or less and is preferably approximately 3.0 μm or more and 10 μm or less. The substrate 50 may be subjected to surface treatment to improve the adhesion to the layer to come into contact with the substrate 50. The surface treatment may be corona discharge treatment, flame treatment, ozone treatment, ultraviolet treatment, radiation treatment, surface roughening treatment, chemical treatment, plasma treatment, grafting treatment, or any other known treatment for improving the surface of the resin. One or two or more of surface treatment techniques may be applied.

Among those surface treatment techniques, corona discharge treatment or plasma treatment are advantageous for low-cost production. Optionally, the substrate 50 may be provided with an undercoat layer on one or both of the surfaces thereof. Primer treatment for forming the undercoat layer may be performed by applying a primer liquid onto the unstretched plastic film extruded from a melt extruder and stretching the film. A rear primer layer (adhesive layer) may be formed between the substrate 50 and the rear surface layer 57 by coating. The rear primer layer may be formed of, for example, polyester-based resin, polyacrylate-based resin, polyvinyl acetate-based resin, polyurethane-based resin, styrene acrylate-based resin, polyacrylamide-based resin, polyamide-based resin, polyether-based resin, polystyrene-based resin, polyethylene-based resin, polypropylene-based resin, vinyl-based resin, such as polyvinyl chloride resin, polyvinyl alcohol resin, and polyvinylidene chloride resin, polyvinyl acetal-based resin, such as polyvinyl acetoacetal and polyvinyl butyral, and cellulose-based resin.

[Dye Layer]

Preferably, materials prepared by melting or dispersing a sublimable dye in a binder resin are used for the dye layers 52. Examples of the sublimable dye include diarylmethane-based dyes; triarylmethane-based dyes; thiazole-based dyes; merocyanine dyes; pyrazolone dyes; methine-based dyes; indoaniline-based dyes; azomethine-based dyes, such as acetophenoneazomethine, pyrazoloazomethine, imidazolazomethine, imidazoazomethine, and pyridoneazomethine; xanthene-based dyes; oxazine-based dyes; cyanostyrene-based dyes, such as dicyanostyrene and tricyanostyrene; thiazine-based dyes; azine-based dyes; acridine-based dyes; benzene azo-based dyes; azo dyes, such as pyridone azo, thiophene azo, isothiazole azo, pyrrole azo, pyrazole azo, imidazole azo, thiadiazole azo, triazole azo, and disazo; spiropyran-based dyes; indolinospiropyran-based dyes; fluorane-based dyes; rhodamine lactam-based dyes; naphthoquinone-based dyes; anthraquinone-based dyes; and quinophthalone-based dyes.

The sublimable dye content in each dye layer is 5% by mass or more and 90% by mass or less, preferably 20% by mass or more and 80% by mass or less, relative to the total solid content of the dye layer. By controlling the content of the sublimable dye to be used, a preferred print density can be achieved, and degradation in storability can be reduced.

The binder resin used to hold the dye is, in general, resistant to heat and appropriately compatible with the dye. Examples of the binder resin include cellulose-based resins, such as ethyl cellulose, hydroxyethyl cellulose, ethyl hydroxy cellulose, hydroxypropyl cellulose, methyl cellulose, cellulose acetate, and cellulose butyrate; vinyl-based resins, such as polyvinyl alcohol, polyvinyl acetate, polyvinyl butyral, polyvinyl acetoacetal, and polyvinylpyrrolidone; acrylic resins, such as poly(meth)acrylates and poly(meth)acrylamide; polyurethane-based resins; polyamide-based resins; and polyester-based resins. Among these binder resins, cellulose-based resins, vinyl-based resins, acrylic resins, urethane-based resins, polyester-based resins, and the like are preferred in terms of, for example, heat resistance and dye transferability. Vinyl-bases resins are more preferred, and polyvinyl butyral, polyvinyl acetoacetal, and the like are particularly preferred.

The dye layers 52 may contain an additive, such as a release agent, inorganic particles, or organic particles. The release agent may be silicone oil, phosphoric acid ester, or the like. The inorganic particles may be particles of carbon black, aluminum, molybdenum disulfide, or the like. The organic particles may be polyethylene wax particles or the like.

The dye layers 52 may be formed by applying a coating liquid, which is prepared by dissolving or dispersing any of the above-cited dyes, the binder resin, and optionally added additives in an appropriate organic solvent or water, onto one of the surfaces of the substrate 50 by a known method, such as gravure printing, screen printing, or reverse roll coating using a gravure plate, and drying the applied coating liquid.

The organic solvent may be toluene, methyl ethyl ketone, ethanol, isopropyl alcohol, cyclohexanone, dimethylformamide [DMF], or the like. Each dye layer, when dried, has a thickness of approximately 0.2 μm or more and 6.0 μm or less, preferably approximately 0.2 μm or more and 3.0 μm or less.

[Protective Layer]

The protective layer 54 is made of a resin conventionally used for forming a protective layer, to which a fluorescent brightening agent, an ultraviolet light absorbing material, or an infrared light absorbing material is added. Examples of the resin used for forming a protective layer include polyester resin, polystyrene resin, acrylic resin, polyurethane resin, acryl urethane resin, vinyl chloride-vinyl acetate copolymer, silicone-modified resins of these resins, and mixtures of these resins.

Examples of the fluorescent brightening agent include fluorescein-based compounds, thioflavin-based compounds, eosin-based compounds, rhodamine-based compounds, coumarin-based compounds, imidazole-based compounds, oxazole-based compounds, triazole-based compounds, carbazole-based compounds, pyridine-based compounds, imidazolone-based compounds, naphthalic acid derivatives, stilbenedisulfonic acid derivatives, stilbenetetrasulfonic acid derivatives, and stilbenehexasulfonic acid derivatives.

Examples of the ultraviolet light absorbing material include organic ultraviolet light absorbing materials, such as benzotriazole-based compounds, triazine-based compounds, benzophenone-based compounds, and benzoate-based compounds, and inorganic ultraviolet light absorbing materials, such as titanium oxide, zinc oxide, cerium oxide, iron oxide, and barium sulfate. In particular, benzotriazole-based compounds are preferably used.

Examples of the infrared light absorbing material include diimonium-based compounds, aluminum-based compounds, phthalocyanine-based compounds, dithiol-based organic metal complexes, cyanine-based compounds, azo-based compounds, polymethine-based compounds, quinone-based compounds, diphenylmethane-based compounds, triphenylmethane-based compounds, and oxol-based compounds.

The protective layer 54 may be formed by, for example, gravure printing application of a coating liquid containing the above-described resin to which an above-described fluorescent brightening agent, ultraviolet light absorbing material or infrared light absorbing material is added, followed by drying. The plate cylinder used in the gravure printing has very small recesses called cells in the surface thereof. The recesses are filled with the coating liquid, and the coating liquid in the recesses is applied onto the substrate 50. In the present embodiment, the protective layer 54 having a recessed or protruding portion (identification mark 55) having a varied thickness is formed by adjusting the recess or protrusion formed at the surface of the plate cylinder.

The thickness of the protective layer 54 (region other than the portion of the identification mark 55), when dried, is preferably 0.1 μm or more and 2.0 μm or less. The thickness of the portion of the identification mark 55 is preferably 65% or more and 80% or less or 125% or more and 150% or less relative to the thickness of the region other than the portion of the identification mark 55.

For a recessed identification mark 55, when the thickness of the portion of the identification mark 55 is 80% or less relative to the thickness of the region other than the portion of the identification mark 55, the values, detected by the detector 20, of the identification mark 55 and the other region have a sufficient difference, and thus the identification mark 55 is easily detected. Also, when the thickness of the portion of the identification mark 55 is 65% or more relative to the thickness of the region other than the portion of the identification mark 55, the recess or protrusion of the identification mark 55 will be inconspicuous on the printed cut sheet 7*a* having a thermally transferred image.

For a protruding identification mark 55, when the thickness of the portion of the identification mark 55 is 125% or more relative to the thickness of the region other than the portion of the identification mark 55, the values, detected by the detector 20, of the identification mark 55 and the other region have a sufficient difference, and thus the identification mark 55 is easily detected. Also, when the thickness of the portion of the identification mark 55 is 150% or less relative to the thickness of the region other than the portion of the identification mark 55, the recess or protrusion of the identification mark 55 will be inconspicuous on the printed cut sheet 7*a* having a thermally transferred image.

[Rear Surface Layer]

The thermal transfer sheet 5 includes the rear surface layer 57 on the surface of the substrate 50 opposite the dye layers 52 and the protective layers 54. The rear surface layer 57 is disposed on that surface of the substrate 50 to increase the runnability for the thermal head 1 during printing, as well as heat resistance.

The rear surface layer 57 is made of a material appropriately selected from the known thermoplastic resins and the like. Examples of such a thermoplastic resin include polyester-based resins, polyacrylate-based resins, polyvinyl acetate-based resins, styrene acrylate-based resins, polyurethane-based resins, polyolefin-based resins, such as polyethylene-based resins and polypropylene-based resins, polystyrene-based resins, polyvinyl chloride-based resins, polyether-based resins, polyamide-based resins, polyimide-based resins, polyamide-imide-based resins, polycarbonate-based resins, polyacrylamide resin, polyvinyl chloride resin, polyvinyl acetal resins such as polyvinyl butyral resin and polyvinyl acetoacetal resin, and silicone-modified forms of these thermoplastic resins.

A curing agent may be added to the thermoplastic resin. The curing agent may be selected from the known polyisocyanate resins without particular limitation, and it is desirable to use an aromatic isocyanate adduct. Examples of such an aromatic polyisocyanate include 2,4-toluene diisocyanate, 2,6-toluene diisocyanate, a mixture of 2,4-toluene diisocyanate and 2,6-toluene diisocyanate, 1,5-naphthalene diisocyanate, tolidine diisocyanate, p-phenylene diisocyanate, trans-cyclohexane-1,4-diisocyanate, xylylene diisocyanate, triphenylmethane triisocyanate, and tris(isocyanatophenyl) thiophosphate. In particular, 2,4-toluene diisocyanate, 2,6-toluene diisocyanate, and a mixture of 2,4-toluene diisocyanate and 2,6-toluene diisocyanate are preferable. Such a polyisocyanate resin causes the hydroxy group of the above-described hydroxy-including thermoplastic resin to form crosslinks, thus increasing the strength and the heat resistance of the coating film for the rear surface layer 57.

In addition to the thermoplastic resin, the rear surface layer 57 may contain wax, a higher fatty acid amide, a phosphate ester compound, metal soap, silicone oil, a surfactant or any other release agent, fluororesin powder or any other organic powder, inorganic particles of silica, clay, talc, calcium carbonate, or the like, and other additives to increase slip properties.

The rear surface layer 57 is formed by applying a coating liquid, which is prepared by, for example, dispersing or dissolving the above-cited thermoplastic resin and optional additives in an appropriate solvent, onto the surface of the substrate 50 opposite the dye layers 52 and the protective layers 54 by a known method, such as gravure printing, screen printing, or reverse roll coating using a gravure plate, and drying the applied coating liquid. The thickness of the rear surface layer, when dried, is preferably 3 μm or less, more preferably 0.1 μm or more and 2 μm or less, from the viewpoint of increasing heat resistance or the like.

In printing operation using the thermal transfer sheet 5, the printing sheet 7 and the Y layer of the dye layers 52 are first caused to correspond in position to each other, and the thermal head 1 is brought into contact with the platen roll 2 with the printing sheet 7 and the thermal transfer sheet 5 interposed therebetween. Then, the printing sheet 7 and the thermal transfer sheet 5 are transported backward by driving for rotation of the capstan roller 9a and the collecting unit 4. During this operation, the region of the Y layer is selectively heated by the thermal head 1 on the basis of image data, so that Y is sublimated and transferred onto the printing sheet 7 from the thermal transfer sheet 5.

After the sublimation transfer of Y, the thermal head 1 rises to separate from the platen roll 2. Subsequently, the printing sheet 7 and the M layer are caused to correspond in position to each other. In this instance, the printing sheet 7 is transported forward by a distance corresponding to the print size, while the thermal transfer sheet 5 is transported backward by a distance corresponding to the margin between the Y layer and the M layer.

M and C are sublimated to be transferred one after the other onto the printing sheet 7 on the basis of image data in a manner similar to the sublimation transfer of Y, thus forming an image on the printing sheet 7.

After the image formation, the printing sheet 7 and the protective layer 54 are caused to correspond in position to each other, and the protective layer 54 is heated by the thermal head 1, thus transferred from the thermal transfer sheet 5 onto the printing sheet 7 so as to cover the image. In the protective layer 54, the portion of the identification mark 55 has a thickness of 65% or more and 80% or less or 125% or more and 150% or less relative to the thickness of the region other than the portion of the identification mark 55. Accordingly, the identification mark 55 in the protective layer after being transferred cannot be perceived by the naked human eye, not affecting the finished quality of the resulting printed item.

From the viewpoint of preventing the appearance of the printed item from being affected by an unwanted change of the portion of the identification mark 55 caused due to the storage period or the storage environment of the printed item, the identification mark 55 may be formed at the periphery of the protective layer 54 that is outside the print region so as not to be transferred to the printing sheet 7. Also, from the viewpoint of reducing the effect on the appearance of the printed item, a linear identification mark 55 may be positioned only at the periphery of the printed item.

In the present embodiment, since the identification mark 55 is formed in the protective layer 54 but not in the dye layers 52, color properties are not affected. In gravure printing, since a coating liquid containing an invisible light absorbing material for forming the protective layer can be applied after adjusting the recess or protrusion at the surface of the plate cylinder, the number of application process steps for forming the identification mark 55 does not increase, and, accordingly, production cost does not increase. The identification mark 55 may have either a recessed portion or a protruding portion or both in combination.

Although the above-described embodiment has described an example in which the pattern (the number of strips or portions, the width, the shape, the position, or the like) of the identification mark 55 formed in the protective layer 54 is varied for each type of thermal transfer sheet 5, the content (added concentration) of the invisible light absorbing material relative to the resin for forming the protective layer may be varied for each type of thermal transfer sheet 5 (without varying the thickness of the protective layer 54). In this instance, the value detected by the detector 20 varies depending on the type of thermal transfer sheet 5. The type of thermal transfer sheet 5 and the intensity of transmitted light or reflected light are recorded in association with each other in the table T in the memory 12.

Also, the invisible light absorbing material added to the resin for forming the protective layer may be changed for each type of thermal transfer sheet 5. In this instance, ultraviolet or infrared light absorption wavelength varies depending on the type of thermal transfer sheet 5. In the table T in the memory 12, absorption wavelength is recorded in association with each type of thermal transfer sheet 5.

Figure 11:
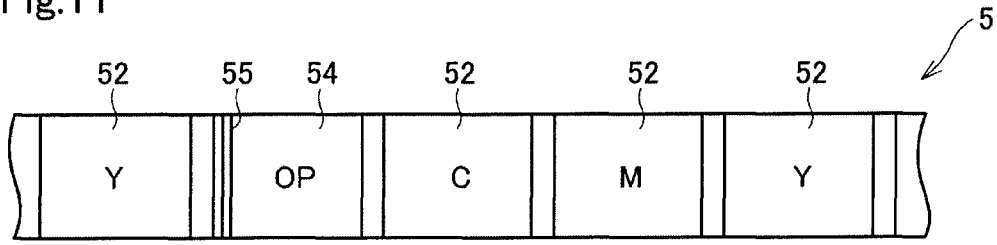
FIG. 11 is a plan view of a thermal transfer sheet.

As shown in FIG. 11, the identification mark 55 may be located at a back end of the protective layer 54 in the longitudinal direction of the sheet so as to be used as a detection mark to determine the position of the following dye layer 52 (Y layer). The identification mark 55 may be located in a region not transferred to the printing sheet 7, for example, in the vicinity of the Y layer.

The above-described embodiment has described an example in which the type of thermal transfer sheet 5 is identified by providing the identification mark 55 (first identification mark) formed in the protective layer 54. As with the thermal transfer sheet 5, the printing sheet 7 may be provided with an identification mark (second identification mark) to identify the type of the printing sheet.

Figure 12:
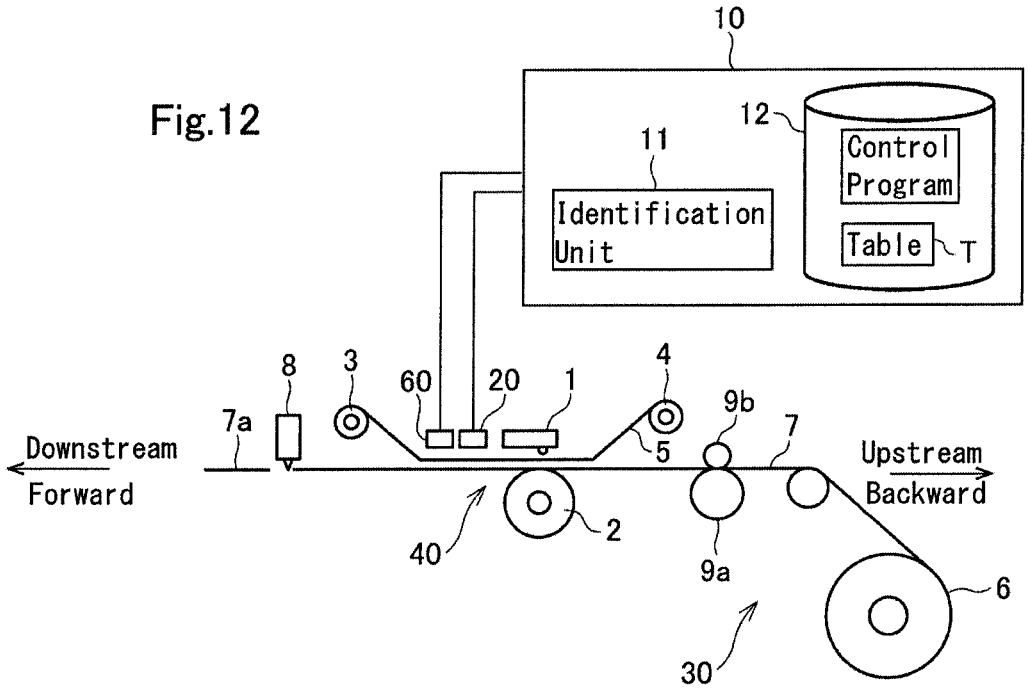
FIG. 12 is a schematic diagram of the structure of a thermal transfer printing apparatus according to another embodiment.
Figure 13:
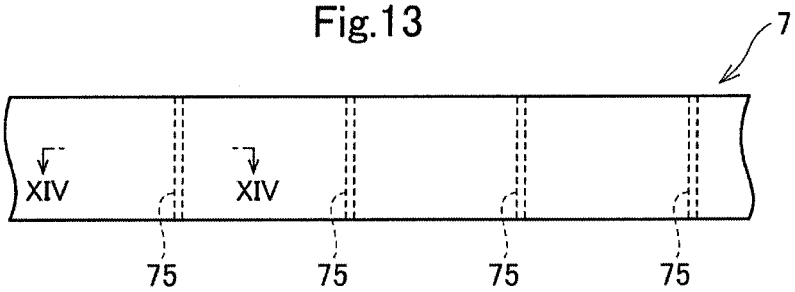
FIG. 13 is a plan view of a printing sheet.
Figure 14A:
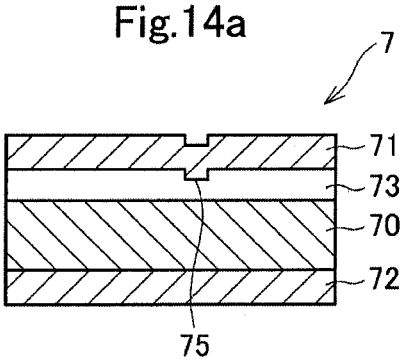
FIGS. 14*a* and 14*b* are each a sectional view taken along line XIV- XIV shown in FIG. 13.
Figure 14B:
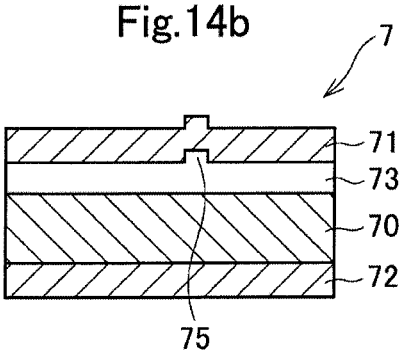

FIG. 12 is a schematic diagram of the structure of a thermal transfer printing apparatus configured to identify also the type of printing sheet 7, FIG. 13 is a plan view of a printing sheet 7, and FIGS. 14*a* and 14*b* are each a sectional view of a printing sheet 7. While the thermal transfer printing apparatus shown in FIG. 1 is provided with a detector 20 (first detector), the thermal transfer printing apparatus shown in FIG. 12 is different in that it is provided with the detector 20 (first detector) and a detector 60 (second detector).

The printing sheet 7 has a receiving layer 71 on one surface of a substrate 70 and a rear surface layer 72 on the other surface. The substrate 70 and the receiving layer 71 are provided with an intermediate layer 73 interposed therebetween to increase adhesion between the substrate 70 and the receiving layer 71. The printing sheet 7 may include further layers.

The intermediate layer 73 contains an invisible light absorbing material. The invisible light absorbing material may be, for example, a fluorescent brightening agent, an ultraviolet light absorbing material, or an infrared light absorbing material. The invisible light absorbing material in the intermediate layer 73 is different from the invisible light absorbing material in the protective layer 54. The detector 20 is suitable for the type of the invisible light absorbing material contained in the protective layer 54, and the detector 60 is suitable for the type of the invisible light absorbing material contained in the intermediate layer 73.

If the intermediate layer 73 contains a fluorescent brightening agent, a fluorescence sensor is used as the detector 60. The sensor irradiates the printing sheet 7 with ultraviolet light and receives fluorescence emitted from the printing sheet 7, thus measuring the fluorescence intensity. If the intermediate layer 73 contains an ultraviolet light absorbing material or an infrared light absorbing material, an ultraviolet sensor or an infrared sensor is used as the detector 60, and the printing sheet 7 is irradiated with ultraviolet light or infrared light, thus measuring the intensity (reflectance or transmittance) of reflected light or transmitted light.

If the detector 20 and the detector 60 are disposed close to each other as shown in FIG. 12, a light source for ultraviolet irradiation may be shared with the detectors. Ultraviolet light emitted from the light source is transmitted through the protective layer 54, and the intermediate layer 73 is irradiated with the ultraviolet light. The ultraviolet light reflected from the intermediate layer 73 or the fluorescence emitted from the intermediate layer 73 is transmitted through the protective layer 54 and detected by the detector 60.

The detector 60 may be disposed between the printing unit 40 and the printing paper roll 6.

The intermediate layer 73 of the printing sheet 7 has an identification mark 75 therein, and the measurement value of the detector 60 by measuring the portion of the identification mark 75 is different from the measurement value of the detector 60 by measuring the region other than the portion of the identification mark 75

For example, the identification mark 75 in the intermediate layer 73 may be defined by a recessed portion having a thickness smaller than the region other than the portion of the identification mark 75, as shown in FIG. 14*a*. Alternatively, the identification mark 75 in the intermediate layer 73 may be defined by a protruding portion having a thickness larger than the region other than the portion of the identification mark 75, as shown in FIG. 14*b*.

For example, the identification mark 75 may be defined by a protruding or recessed strip (line pattern) extending in the width direction (the transverse direction (short length direction) of the sheet perpendicular to the longitudinal direction of the sheet) of the printing sheet 7. In this instance, when the detector 60 irradiates the printing sheet 7 fed and transported from the printing paper roll 6 with ultraviolet light or infrared light and scans the printing sheet 7 in the longitudinal direction, the measurement value varies at an edge of the identification mark 75. The detector thus can detect the pattern of the identification mark 75 represented by the number of strips or portions, the width, the shape, the position and the like of the mark. Identification marks 75 are provided at regular intervals.

For example, in the case of the intermediate layer 73 containing a fluorescent brightening agent, the position at which the intensity of fluorescence received by the detector 60 increases (decreases) corresponds to the edge of one of the ends of the identification mark 75, and then, the position at which the fluorescence intensity decreases (increases) corresponds to the edge of the other end of the identification mark 75.

Plural types of printing sheet 7 may be loaded in the thermal transfer printing apparatus. The type of printing sheet 7 and the pattern (the number of strips or portions, the width, the shape, and the position) of the identification mark 75 are recorded in association with each other in the table T in the memory 12. For example, the number of strips, the width, the position or the like of the identification mark 75 varies depending on the type of printing sheet 7.

The identification unit 11 refers to the table T and identifies the type of printing sheet 7 from the detection result of the detector 60 for the identification mark 75.

In the table T, preferred combinations between thermal transfer sheets 5 and printing sheets 7 may be registered. If the type of thermal transfer sheet 5 and the type of printing sheet 7 that have been identified by the identification unit 11 do not correspond to any of the registered combinations, the control device 10 may output an alarm sound or a warning sign or may cancel the printing operation.

After printing operation in the printing unit 40, a cutter 8 cuts the printing sheet 7 in the width direction at the boundary between a region for a printed cut sheet and a region for a margin. The region for a printed cut sheet is ejected as the printed cut sheet 7*a* through the ejection port. On the other hand, the region for a margin is cut off as a margin piece and collected in a collection container (not shown) disposed right under the cutter 8.

The image is printed slightly larger than the region for the printed cut sheet. Thus, the image is printed over the entire surface of the printed cut sheet 7*a* even if the cutting position of the cutter 8 is slightly shifted.

The above-cited identification mark 75 may be formed in the region of a margin that will be collected as a margin piece.

The substrate 70 of the printing sheet 7 may be high-quality paper, coated paper, resin-coated paper, art paper, cast-coated paper, paperboard, synthetic paper (polyolefin-based paper, polystyrene-based paper), synthetic resin or emulsion-impregnated paper, synthetic rubber latex-impregnated paper, synthetic resin internally added paper, cellulose fiber paper, or the like. The thickness of the substrate 70 may be, but is not limited to, approximately 10 μm or more and 300 μm or less.

The receiving layer 71 contains a binder resin and a release agent. The binder resin may be a known resin material that can easily receive the dyes contained in the dye layers of the thermal transfer sheet. The release agent is intended to facilitate easy release of the thermal transfer sheet from the dye layers and may be silicone oil, polyethylene wax, amide wax, or a fluorine-based or phosphate ester-based surfactant, or the like.

The rear surface layer 72 may be a layer having a desired function, appropriately selected in accordance with the use of the printing sheet 7. For example, a rear surface layer 72 having a function to facilitate the transfer of the printing sheet 7 or a function to prevent curling is preferably used.

For the intermediate layer 73, an invisible light absorbing material is added to a known resin functioning as a good adhesive between the substrate 70 and the receiving layer 71. Examples of such a resin include polyurethane resin, acrylic resin, polyethylene resin, polypropylene resin, and epoxy resin.

The thickness of the intermediate layer 73 (region other than the portion of the identification mark 75), when dried, is preferably 0.1 μm or more and 2.0 μm or less. The thickness of the portion of the identification mark 75 is preferably 65% or more and 80% or less or 125% or more and 150% or less relative to the thickness of the region other than the portion of the identification mark 75.

For a recessed identification mark 75, when the thickness of the portion of the identification mark 75 is 80% or less relative to the thickness of the region other than the portion of the identification mark 75, the values, detected by the detector 60, of the identification mark 75 and the other region have a sufficient difference, and thus the identification mark 75 is easily detected. Also, when the thickness of the portion of the identification mark 75 is 65% or more relative to the thickness of the region other than the portion of the identification mark 75, the recess or protrusion of the identification mark 75 will appear inconspicuously at the surface of the receiving layer 71. If the identification mark 75 is formed in a region for a margin, the recess or protrusion will not appear at the surface of the printed cut sheet 7*a*.

For a protruding identification mark 75, when the thickness of the portion of the identification mark 75 is 125% or more relative to the thickness of the region other than the portion of the identification mark 75, the values, detected by the detector 60, of the identification mark 75 and the other region have a sufficient difference, and thus the identification mark 75 is easily detected. Also, when the thickness of the portion of the identification mark 75 is 150% or less relative to the thickness of the region other than the portion of the identification mark 75, the recess or protrusion of the identification mark 75 will be inconspicuous on the printed cut sheet 7*a* having a thermally transferred image. If the identification mark 75 is formed in a region for a margin, the recess or protrusion will not appear at the surface of the printed cut sheet 7*a*, as described above.

The identification mark 75 may have either a recessed portion or a protruding portion or both in combination.

Although an example in which the pattern (the number of strips or portions, the width, the shape, the position, and the like) of the identification mark 75 is varied for each type of printing sheet 7, the content of the invisible light absorbing material in the intermediate layer 73 may be varied for each type of printing sheet 7 (without varying the thickness of the intermediate layer 73). In this instance, the value (received light intensity) detected by the detector 60 varies depending on the type of printing sheet 7. Types of printing sheet 7 and detection values are recorded in association with each other in the table T in the memory 12.

When the detector 20 and the detector 60 are disposed close to each other so as to share the ultraviolet emission light source with each other and detect the identification mark 55 and the identification mark 75 in a state where the protective layer 54 and the printing sheet 7 lie one on the other, as shown in FIG. 12, the identification mark 55 and the identification mark 75 may be detected simultaneously or independently.

For simultaneously detecting the identification mark 55 and the identification mark 75, if the invisible light absorbing material in the protective layer 54 and the invisible light absorbing material in the intermediate layer 73 are the same, it is difficult to determine which the identification mark 55 or the identification mark 75 has produced a change in light intensity detected by the detector.

For simultaneously detecting the identification mark 55 and the identification mark 75, it is therefore preferable that the invisible light absorbing material contained in the protective layer 54 and the invisible light absorbing material contained in the intermediate layer 73 be different from each other. Particularly in view of the quality of printed items (printed cut sheets 7*a*) to be produced, it is preferable that the protective layer 54 contains an ultraviolet light absorbing material, while the intermediate layer 73 contains a fluorescent brightening agent.

The intermediate layer 73 is irradiated with ultraviolet light transmitted through the identification mark 55 of the protective layer 54. From the viewpoint of reducing the attenuation of ultraviolet light by the transmission through the identification mark 55 so that the intermediate layer 73 can be irradiated with ultraviolet with a sufficient intensity, the identification mark 55 is preferably defined by a recessed form.

The present invention is not limited to the above described embodiments as they are, and the elements thereof may be modified without departing from the scope and spirit of the invention when the invention is implemented. Also, appropriate combinations of the elements or components disclosed in the above-described embodiments can lead to various inventions. For example, some of the elements used in the embodiments may be omitted. Furthermore, some elements used in an embodiment may be combined with elements used in another embodiment as required.

The present application is based on Japanese Patent Application No. 2017-148112 filed on Jul. 31, 2017 and Japanese Patent Application No. 2018-008302 filed on Jan. 22, 2018, the entirety of which is incorporated herein by reference.

REFERENCE SIGNS LIST

1 thermal head
2 platen roll
3 feeder
4 collecting unit
5 thermal transfer sheet
7 printing sheet
10 control device
11 identification unit
12 memory
20 detector (first detector)
40 printing unit
50 Substrate
52 dye layer
54 protective layer
55 identification mark
60 detector (second detector)
75 identification mark

The invention claimed is:

1. A thermal transfer sheet comprising:
a substrate;
a dye layer disposed on one surface of the substrate; and
a protective layer disposed on the surface of the substrate, the protective layer being provided in a region that is different from the dye layer,
wherein the protective layer contains an invisible light absorbing material and is provided with an identification mark having at least one of a recessed portion and a protruding portion.

2. The thermal transfer sheet according to claim 1, wherein the identification mark has a protruding strip or a recessed strip.

3. The thermal transfer sheet according to claim 2, wherein the protruding strip or the recessed strip extends in a transverse direction of the sheet.

4. The thermal transfer sheet according to claim 1, wherein a periphery of the protective layer is not transferred to printing paper, and the identification mark is located at the periphery of the protective layer.

5. A thermal transfer printing apparatus including a thermal head and a platen roll and in which the thermal head heats the thermal transfer sheet according to claim 1 to transfer a dye onto a printing paper while the thermal transfer sheet and the printing paper, lying one on the other, are transported between the thermal head and the platen roll, thus forming an image on the printing paper and transferring the protective layer onto the image, the thermal transfer printing apparatus comprising:
a detector disposed between a feeder feeding the thermal transfer sheet and the thermal head, the detector detecting the identification mark;
a memory storing a table in which a type of the thermal transfer sheet and a pattern of the identification mark are associated with each other; and
an identification unit referring to the table and identifying the thermal transfer sheet fed from the feeder based on the pattern detected by the detector.

6. The thermal transfer printing apparatus according to claim 5, wherein the pattern of the identification mark is represented by the number of strips or portions, a width, a shape or a position of the identification mark.

7. The thermal transfer printing apparatus according to claim 5, wherein the table contains printing conditions associated with each type of the thermal transfer sheet, and
wherein printing operation is performed under the printing conditions associated with the type of the thermal transfer sheet identified by the identification unit.

8. A thermal transfer printing apparatus including a thermal head and a platen roll and in which the thermal head heats a thermal transfer sheet including a dye layer and a protective layer containing an invisible light absorbing material to transfer a dye onto a printing paper while the thermal transfer sheet and the printing paper, lying one on the other, are transported between the thermal head and the platen roll, thus forming an image on the printing paper and transferring the protective layer onto the image, the thermal transfer printing apparatus comprising:

a detector disposed between a feeder feeding the thermal transfer sheet and the thermal head, the detector applying invisible light to the protective layer and measuring an intensity of invisible light transmitted through or reflected from the protective layer;

a memory storing a table in which a type of the thermal transfer sheet and the intensity are associated with each other; and an identification referring to the table and identifying the thermal transfer sheet fed from the feeder based on a measurement result of the detector.

9. A printing sheet comprising:

a substrate;

an intermediate layer disposed on the substrate; and a receiving layer disposed on the intermediate layer, wherein the intermediate layer contains an invisible light absorbing material and is provided with an identification mark including at least one of a recessed portion and a protruding portion.

10. The printing sheet according to claim 9, wherein the identification mark includes a protruding strip or a recessed strip.

11. A thermal transfer printing apparatus including a thermal head and a platen roll and in which the thermal head heats the thermal transfer sheet according to claim 1 to transfer a dye onto a printing sheet while the thermal transfer sheet and the printing sheet, lying one on the other, are transported between the thermal head and the platen roll, thus forming an image on the printing sheet and transferring the protective layer onto the image, the thermal transfer printing apparatus comprising:

a first detector disposed between a feeder feeding the thermal transfer sheet and the thermal head, the first detector detecting a first identification mark provided in the protective layer;

a second detector detecting a second identification mark provided in the intermediate layer;

a memory storing a table in which a type of the thermal transfer sheet and a pattern of the first identification mark are associated with each other and a table in which a type of the printing sheet and a pattern of the second identification mark are associated with each other; and an identification unit referring to the tables, identifying the type of the thermal transfer sheet based on the pattern detected by the first detector, and identifying the type of the printing sheet based on the pattern detected by the second detector, wherein the printing sheet comprises a substrate, an intermediate layer disposed on the substrate, and a receiving layer disposed on the intermediate layer, wherein the intermediate layer contains an invisible light absorbing material and is provided with an identification mark including at least one of a recessed portion and a protruding portion.

12. The thermal transfer printing apparatus according to claim 11, further comprising a light source applying invisible light to the thermal transfer sheet and the printing sheet, wherein the printing sheet is irradiated with invisible light transmitted through the protective layer, wherein the first detector receives light from the protective layer, and wherein the second detector receives light from the printing sheet, the light having been transmitted through the protective layer.

13. The thermal transfer printing apparatus according to claim 12, wherein the protective layer of the thermal transfer sheet contains an ultraviolet light absorbing material, and the intermediate layer of the printing sheet contains a fluorescent brightening agent.

* * * * *